US011820093B2

(12) United States Patent
Tanaka et al.

(10) Patent No.: US 11,820,093 B2
(45) Date of Patent: Nov. 21, 2023

(54) HOT-PRESS DEVICE

(71) Applicants: IHI CORPORATION, Tokyo (JP); IHI MACHINERY AND FURNACE CO., LTD., Tokyo (JP)

(72) Inventors: Toshiro Tanaka, Yokosuka (JP); Hideki Kawamoto, Iwakuni (JP); Takuma Yoshida, Tokyo (JP); Hiroyuki Konishi, Yokohama (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 779 days.

(21) Appl. No.: 16/825,108

(22) Filed: Mar. 20, 2020

(65) Prior Publication Data

US 2020/0215781 A1 Jul. 9, 2020

Related U.S. Application Data

(63) Continuation of application No. PCT/JP2018/047006, filed on Dec. 20, 2018.

(30) Foreign Application Priority Data

Dec. 25, 2017 (JP) ..... 2017-247445

(51) Int. Cl.
*B30B 11/02* (2006.01)
*B22F 3/03* (2006.01)
(Continued)

(52) U.S. Cl.
CPC ..... *B30B 11/02* (2013.01); *B22F 3/03* (2013.01); *B30B 15/065* (2013.01); *B30B 15/34* (2013.01); *B22F 2003/031* (2013.01)

(58) Field of Classification Search
CPC ..... B30B 11/00; B30B 11/02; B30B 11/26; B30B 15/00; B30B 15/026; B30B 15/028;
(Continued)

(56) References Cited

U.S. PATENT DOCUMENTS 3,156,011 A * 11/1964 Olson ..... B30B 15/0005 425/77
3,797,986 A * 3/1974 Onder ..... B30B 15/02 425/405.2
5,461,928 A 10/1995 Azzolini et al.

FOREIGN PATENT DOCUMENTS

CN 2012-49535 Y 6/2009
CN 105196590 A 12/2015
(Continued)

OTHER PUBLICATIONS

International Search Report issued in Application No. PCT/JP2018/047006, dated Mar. 12, 2019, 4 pages.

*Primary Examiner* — Thu-Khanh T. Nguyen
(74) *Attorney, Agent, or Firm* — Rothwell, Figg, Ernst & Manbeck, P.C.

(57) ABSTRACT

A hot-press device includes: a heating furnace; a pair of punches which includes an upper punch and a lower punch provided in the heating furnace and vertically facing each other; a lower press ram which is connected to a lower surface of the lower punch; an upper press ram which is connected to an upper surface of the upper punch; and a pressing device which is connected to any one or both of the lower press ram and the upper press ram and presses the punch so that the pair of punches are close to each other, in which the lower press ram and/or the upper press ram includes a plurality of individual press rams which are disposed at intervals, each individual press ram having one end coupled to the pair of punches.

4 Claims, 3 Drawing Sheets

(51) Int. Cl.
*B30B 15/06* (2006.01)
*B30B 15/34* (2006.01)

(58) Field of Classification Search
CPC ..... B30B 15/06; B30B 15/062; B30B 15/065; B29C 43/00; B29C 43/02; B29C 43/04; B29C 43/32; B29C 43/36
See application file for complete search history.

(56) References Cited

FOREIGN PATENT DOCUMENTS

| | | | | |
|---|---|---|---|---|
| CN | 105312384 | A | | 2/2016 |
| CN | 206394097 | U | | 8/2017 |
| CN | 206465506 | U | | 9/2017 |
| CN | 209214385 | U | * | 8/2019 |
| DE | 102007047473 | A | * | 9/2007 |
| JP | S54-028474 | A | | 3/1979 |
| JP | 01-102696 | U | | 7/1989 |
| JP | H01-174894 | A | | 7/1989 |
| JP | H07-174894 | A | | 7/1989 |
| JP | H02-295700 | A | | 12/1990 |
| JP | H05-014156 | Y2 | | 4/1993 |
| JP | H08-178546 | A | | 7/1996 |
| JP | H08-313166 | A | | 11/1996 |
| JP | 2000-073106 | A | | 3/2000 |
| JP | 2002-059231 | A | | 2/2002 |
| JP | 2002363611 | A | | 12/2002 |
| JP | 2004-050275 | A | | 2/2004 |
| JP | 2012035324 | A | * | 2/2012 |
| JP | 2015-223625 | A | | 12/2015 |

* cited by examiner

HOT-PRESS DEVICE

CROSS-REFERENCE TO RELATED APPLICATIONS

This application is a Continuation application based on International Application No. PCT/JP2018/047006, filed Dec. 20, 2018, which claims priority on Japanese Patent Application No. 2017-247445, filed Dec. 25, 2017, the contents of which are incorporated herein by reference.

TECHNICAL FIELD

The present disclosure relates to a hot-press device.

BACKGROUND

Patent Document 1 listed below discloses a hot-press device which performs pressure molding on a sample by two punches while heating the sample. In this hot-press device, a heater for heating is provided on sides of an upper punch and a lower punch disposed in an up-down direction, and a powdery sample is accommodated between the upper punch and the lower punch. The upper punch is pushed down by an upper hydraulic cylinder via an upper ram, and the lower punch is pushed up by a lower hydraulic cylinder via a lower ram, and thus, pressure molding (hot-press processing) is performed on the sample while heating the sample.

DOCUMENT OF RELATED ART

Patent Document

[Patent Document 1] Japanese Utility Model Publication No. H05-14156

SUMMARY

In the above-described hot-press device of the related art, when pressing surfaces of the upper punch and the lower punch abutting the sample are large, that is, the hot press processing is performed on a larger sample, it is difficult to maintain uniformity in distribution of a pressing force. That is, a pressing force on the pressing surface of the upper punch is larger in the vicinity of a portion of the upper punch facing the upper ram on a rear surface side than an outer peripheral portion of this portion. In addition, a pressing force to the pressing surface of the lower punch is larger in the vicinity of a portion of the lower punch facing the lower ram on a rear surface side than an outer peripheral portion of this portion.

The present disclosure is made in consideration of the above-described circumstances, and an object thereof is to maintain the uniformity in distribution of a pressing force even when dimension of a pressing surface of a punch increase.

A hot-press device of an aspect of the present disclosure includes: a heating furnace; a pair of punches which includes an upper punch and a lower punch provided in the heating furnace and vertically facing each other; a lower press ram which is connected to a lower surface of the lower punch; an upper press ram which is connected to an upper surface of the upper punch; and a pressing device which is connected to any one or both of the lower press ram and the upper press ram and presses the punch so that the pair of punches are close to each other, in which the lower press ram and/or the upper press ram includes a plurality of individual press rams which are disposed at intervals, each individual press ram having one end coupled to the pair of punches.

In the hot-press device of the aspect, the pressing device may be connected to the upper press ram, and the upper press ram may further include: a single main press ram which is provided on a side of the pressing device; and a coupling member which couples the plurality of individual press rams and the main press ram to each other.

In the hot-press device of the aspect, each of the upper punch and the lower punch may include a pressing surface which abuts an object to be treated and a rear surface opposite to the pressing surface, the object to be treated being disposed between the upper punch and the lower punch, the pressing surface and the rear surface being rectangular, and the plurality of individual press rams may be disposed in the vicinity of four vertexes and at a center of the rear surface.

In the hot-press device of the aspect, each of the upper punch and the lower punch may include a pressing surface which abuts an object to be treated and a rear surface opposite to the pressing surface, the object to be treated being disposed between the upper punch and the lower punch, the pressing surface and the rear surface being circular, and plurality of individual press rams may be disposed at a center of the rear surface and at a plurality of equiangular positions around the center in the vicinity of a peripheral edge of the rear surface.

In the hot-press device of the aspect, the heating furnace may include: a furnace body; a heat insulating container which is provided in the furnace body and accommodates the pair of punches; and a heating element which is provided around the pair of punches in the heat insulating container, in which the heat insulating container includes a plurality of openings through which the plurality of individual press rams are inserted.

According to the present disclosure, even when dimension of a pressing surface of a punch increase, uniformity in distribution of a pressing force can be maintained.

DESCRIPTION OF EMBODIMENTS

Figure 1:
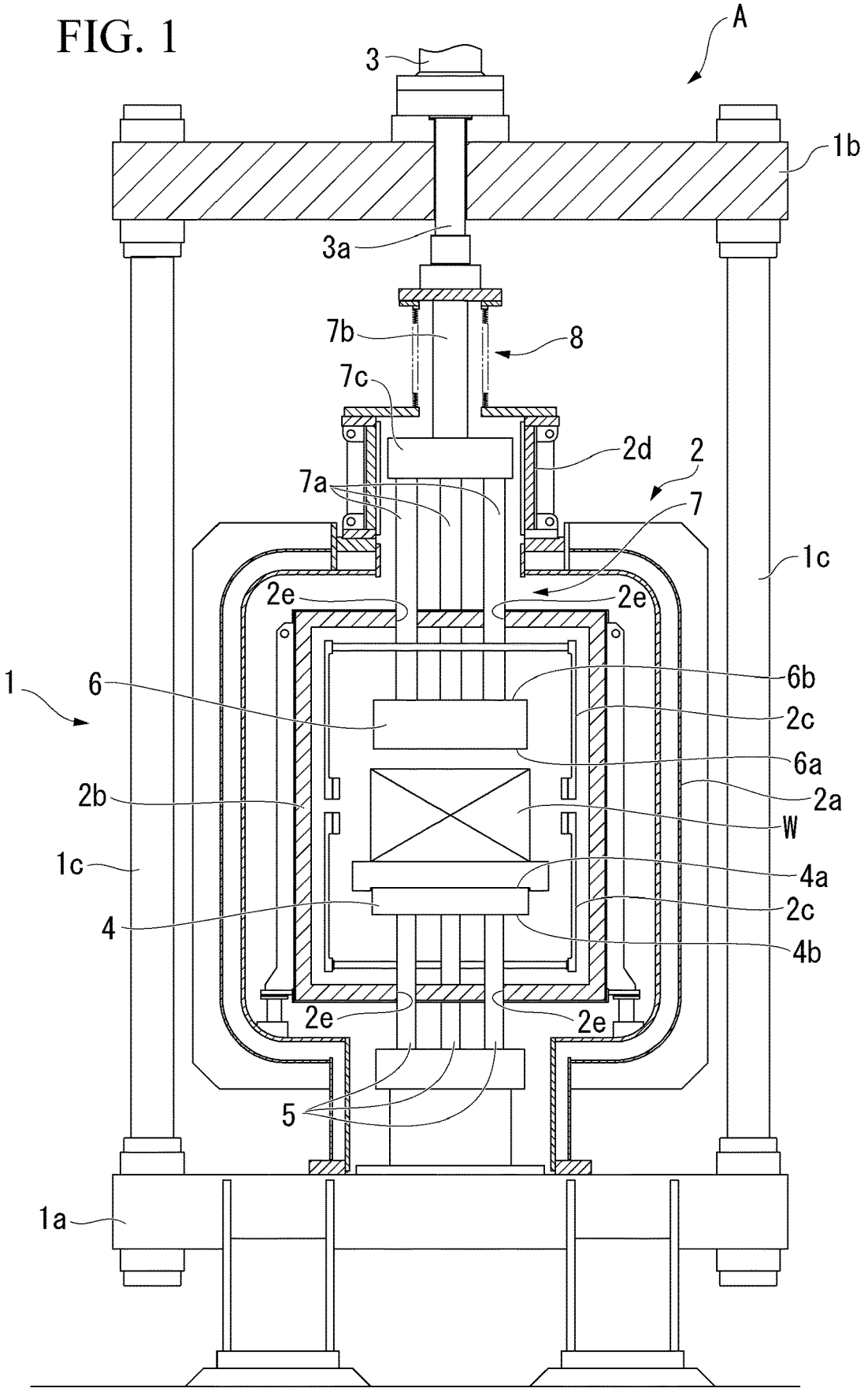
FIG. 1 is a front view showing an overall configuration of a hot-press device A according to an embodiment of the present disclosure.

Hereinafter, an embodiment of the present disclosure will be described with reference to the drawings. As shown in FIG. 1, a hot-press device A according to the present embodiment includes a support mechanism 1, a heating furnace 2, a hydraulic cylinder 3 (pressing device), a lower punch 4, lower press rams 5, an upper punch 6, an upper press ram 7, an extensible portion 8, and the like.

The hot-press device A performs a predetermined process on an object W to be treated by pressing the object W to be treated accommodated between the lower punch 4 and the upper punch 6 in a vacuum heating environment. For example, the processing (hot press processing) performed on the object W to be treated by the hot-press device A includes diffusion bonding processing for a plurality of objects W to be treated which are stacked one above the other, sintering processing for powder-like object W to be treated, or the like. The object W to be treated in the case of the diffusion bonding processing is formed of a plurality of members stacked one above the other, and the object W to be treated in the case of the sintering processing is formed of powder accommodated in a predetermined container.

The support mechanism 1 is a metal frame which is provided so as to surround the heating furnace 2, and is a strength member which receives a reaction force of a hydraulic cylinder 3 (pressing device). As shown in the drawings, the support mechanism 1 includes a lower frame 1*a*, an upper frame 1*b*, and a plurality of coupling rods 1*c*. The lower frame 1*a* is a strength member which is provided in a lower portion of the hot-press device A and has a substantially flat plate shape having a substantially rectangular outer shape. The lower frame 1*a* is fixed to an installation floor of the hot-press device A. The upper frame 1*b* is a strength member formed in substantially the same shape as that of the lower frame 1*a* and is provided above the lower frame 1*a* so as to face the lower frame 1*a* in parallel with a predetermined distance.

The plurality of coupling rods 1*c* are provided to extend between the lower frame 1*a* and the upper frame 1*b* and fix the lower frame 1*a* and the upper frame 1*b*. For example, four coupling rods 1*c* are provided in the vicinity of respective vertexes (four locations) of the rectangular lower frame 1*a* and upper frame 1*b*.

The heating furnace 2 has a vertically placed cylindrical shape and is fixed on the lower frame 1*a* in a state where the heating furnace 2 is surrounded by the plurality of coupling rods 1*c*. That is, the heating furnace 2 is fixed in a state where the heating furnace 2 is interposed between the lower frame 1*a* and the upper frame 1*b* in an up-down direction and is surrounded by the plurality of coupling rods 1*c* in the horizontal direction.

In addition, the heating furnace 2 includes a furnace body 2*a*, a heat insulating container 2*b*, a heater 2*c* (heating element), and a ram accommodation portion 2*d*. The furnace body 2*a* is a vertically placed cylindrical vacuum chamber. The heat insulating container 2*b* is formed of a heat insulating material in a vertically placed cylindrical shape and provided in the furnace body 2*a*, and accommodates the lower punch 4 and the upper punch 6. The heat insulating container 2*b* includes a plurality of openings 2*e* through which the lower press rams 5 (individual press rams) and individual press rams 7*a* described later are inserted.

Moreover, opening/closing doors (not shown) are provided in the furnace body 2*a* and the heat insulating container 2*b*. The opening/closing doors are provided to accommodate the object W to be treated before processing in the heat insulating container 2*b*, that is, in the heating furnace 2, and to take out the object W to be treated after processing to the outside.

The heater 2*c* is a heating element which is provided around the lower punch 4 and the upper punch 6 in the heat insulating container 2*b*. That is, the heater 2*c* is disposed so as to surround the object W to be treated, the lower punch 4, and the upper punch 6, and uniformly heats the object W to be treated, the lower punch 4, and the upper punch 6. The ram accommodation portion 2*d* is a hollow portion protruding toward an upper portion of the heating furnace 2, and accommodates a portion of the upper press ram 7.

Here, a vacuum pump (not shown) serving as an auxiliary machine is provided in the heating furnace 2. An internal atmosphere of the heating furnace 2 is set to a predetermined vacuum atmosphere by operating the vacuum pump. In addition, the vacuum pump and the heater 2*c* are controlled by a controller (not shown). The controller is a software controller which controls operations of various controlled portions such as the vacuum pump and the heater 2*c* based on detection values of various sensors mounted on the heating furnace 2, the upper frame 1*b*, and the like and a dedicated control program stored in advance.

The hydraulic cylinder 3 is a pressing device which is fixed to an upper portion of the support mechanism 1, that is, to the upper frame 1*b*. The hydraulic cylinder 3 includes a movable rod 3*a* which can move up and down, and is connected to a first end (upper end) of the upper press ram 7 in a state where a guide member 8 is interposed between a distal end (lower end) of the movable rod 3*a* and the first end (upper end) of the upper press ram 7. The hydraulic cylinder 3 presses the upper punch 6 located on the upper side of the pair of punches, that is, the lower punch 4 and the upper punch 6, such that the upper punch 6 approaches the lower punch 4. An operation of the hydraulic cylinder 3 is controlled by the controller.

The lower punch 4 is positioned on the lower side in the heating furnace 2, and includes a pressing surface 4*a* which abuts a lower end of the object W to be treated and a rear surface 4*b* (lower surface) parallel to the pressing surface 4*a*. Each of the pressing surface 4*a* and the rear surface 4*b* is planar and is square when viewed from the top.

The lower press rams 5 are a plurality of rod-shaped members which couple the rear surface 4*b* (lower surface) of the lower punch 4 and the lower frame 1*a* of the support mechanism 1 to each other. The lower press rams 5 are constituted by a plurality of individual press rams which extend in the vertical direction and are disposed at predetermined intervals in the horizontal direction, and a first end (upper end) of each individual press ram is coupled to the rear surface 4*b* (lower surface) of the lower punch 4. The lower press rams 5 (individual press rams) are disposed in the vicinity of the four vertexes and at a center of the rectangular rear surface 4*b* of the lower punch 4. That is, a total of five lower press rams 5 (individual press rams), which extend in the vertical direction, are provided between the lower punch 4 and the lower frame 1*a* at predetermined intervals in the horizontal direction.

The upper punch 6 is positioned on the upper side in the heating furnace 2, and includes a pressing surface 6*a* which abuts an upper end of the object W to be treated and a rear surface 6*b* (upper surface) parallel to the pressing surface 6*a*. The pressing surface 6*a* and the rear surface 6*b* are planar and are square having the same shapes as those of the pressing surface 4*a* and the rear surface 4*b* of the lower punch 4. The upper punch 6 has a size and a posture which overlap the lower punch 4 when viewed from above or below. The upper punch 6 and the lower punch 4 are a pair of punches which faces each other in the vertical direction.

Figure 2A:
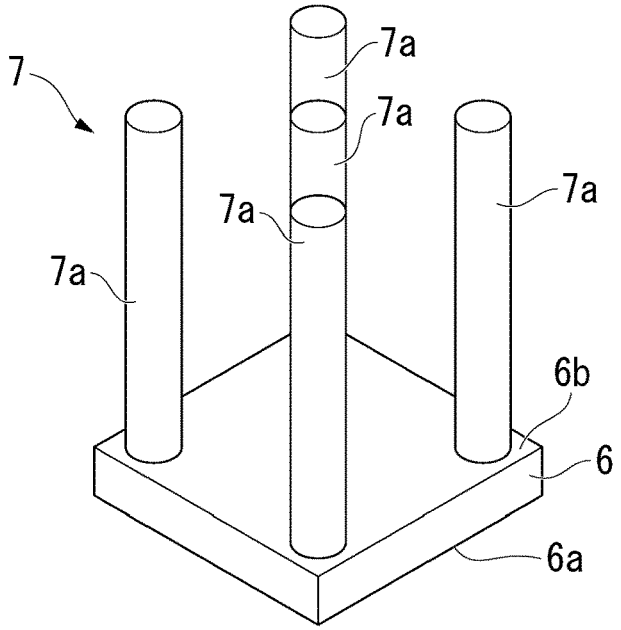
FIG. 2A is a perspective view showing a coupling structure of individual press rams and an upper punch in the embodiment of the present disclosure.
Figure 2B:
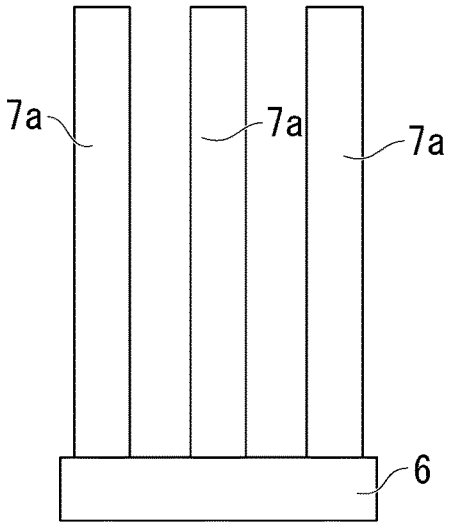
FIG. 2B is a side view showing the coupling structure of the individual press rams and the upper punch in the embodiment of the present disclosure.
Figure 2C:
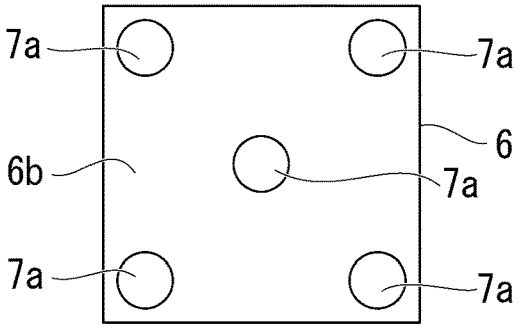
FIG. 2C is a top view showing the coupling structure of the individual press rams and the upper punch in the embodiment of the present disclosure.

The upper press ram 7 includes a plurality of individual press rams 7*a*, a single main press ram 7*b*, and a coupling member 7*c*. The individual press rams 7*a* are rod-shaped members which are provided on the upper punch 6 side between the rear surface 6*b* (upper surface) of the upper punch 6 and the upper frame 1*b*. The plurality of individual press rams 7*a* extend in the vertical direction and are disposed at predetermined intervals in the horizontal direction, and a first end (lower end) of each individual press ram 7*a* is coupled to the rear surface 6*b* (upper surface) of the upper punch 6. As shown in FIGS. 2A to 2C, the individual press rams 7*a* are arranged in the vicinity of four vertexes and at a center of the rectangular rear surface 6*b* of the upper punch 6. That is, a total of five individual press rams 7*a*, which extend in the vertical direction, are provided between the upper punch 6 and the upper frame 1*b* at predetermined intervals in the horizontal direction.

The main press ram 7*b* is a single rod-shaped member extending in the vertical direction and provided on the upper frame 1*b* side, that is, the hydraulic cylinder 3 side (pressing device side) between the upper punch 6 and the upper frame 1*b*. The main press ram 7*b* is a rod-shaped member having a diameter larger than that of the individual press ram 7*a*, and is provided coaxially with the individual press ram 7*a* disposed at the center of the rear surface 6*b* of the upper punch 6.

The coupling member 7*c* is a member which couples the plurality of individual press rams 7*a* and the single main press ram 7*b* to each other. A lower surface of the coupling member 7*c* is connected to second ends (upper ends) of the plurality of individual press rams 7*a*, and an upper surface of the coupling member 7*c* is connected to a second end (lower end) of the single main press ram 7*b*.

The extensible portion 8 is an extensible cylindrical member which surrounds a peripheral surface of the main press ram 7*b* of the upper press ram 7. A first end of the extensible portion 8 is fixed to the movable rod 3*a*, and a second end of the extensible portion 8 is connected to an upper end of the ram accommodation portion 2*d*. As shown in the drawings, a circular opening is formed at an upper end of the ram accommodation portion 2*d*, and the second end of the extensible portion 8 is connected to a portion of the ram accommodation portion 2*d* in the vicinity of an outer periphery of the opening. The extensible portion 8 is a buffer member which ensures sealability of the heating furnace 2 while realizing upward/downward movement of the upper press ram 7. For example, the extensible portion 8 includes one cylindrical tube and a pair of cylindrical bellows provided above and below the cylindrical tube.

Next, an operation of the hot-press device A according to the present embodiment will be described in detail.

In the hot-press device A, when the object W to be treated is accommodated in the heating furnace 2 and a worker inputs a processing start instruction to the controller, each controlled portion is operated by the controller and a predetermined processing for the object W to be treated starts.

First, in the hot-press device A, the vacuum pump is operated to set an atmospheric pressure in the heating furnace 2 to a target vacuum (processing pressure), and power supply to the heater 2*c* starts to set an atmospheric temperature in the heating furnace 2 to a predetermined target temperature (processing temperature). In the hot-press device A, when the inside of the heating furnace 2 is set to the processing pressure and the processing temperature, an operation of the hydraulic cylinder 3 starts to press the object W to be treated with a predetermined target load (processing load).

That is, when the hydraulic cylinder 3 is operated, the upper punch 6 located above the object W to be treated in an initial state is gradually lowered, and the pressing surface 6*a* of the upper punch 6 comes into contact with the upper end of the object W to be treated. Here, as described above, the abutment portion 6*b* of the upper punch 6 is in a posture along the upper end of the object W to be treated.

Here, the upper press ram 7 includes the plurality of individual press rams 7*a* disposed at predetermined intervals on the rear surface 6*b* of the upper punch 6 which is square in top view. Accordingly, a uniform pressing force acts on the pressing surface 6*a* of the upper punch 6 which is square in top view.

In addition, the lower press ram 5 includes a total of five (a plurality of) individual press rams disposed at predetermined intervals on the rear surface 4*b* of the lower punch 4 which is square in top view. Accordingly, a uniform reaction force acts on the pressing surface 4*a* of the lower punch 4 which is square in top view.

Therefore, in the hot-press device A according to the present embodiment, even if dimensions of the pressing surfaces of the pair of punches, that is, the lower punch 4 and the upper punch 6 increase, uniformity in distribution of the pressing force on the pressing surface 6*a* can be maintained.

Moreover, the upper press ram 7 in the hot-press device A includes the plurality of individual press rams 7*a*, the single main press ram 7*b*, and the coupling member 7*c* which couples the plurality of individual press rams 7*a* and the single main press ram 7*b* to each other. Therefore, even when the dimensions of the pressing surfaces of the pair of punches, that is, the lower punch 4 and the upper punch 6 increase, the uniformity in distribution of the pressing force on the pressing surface 6*a* can be maintained and a stable pressing force can act on the object W to be treated.

Moreover, the upper press ram 7 in the hot-press device A includes a total of five individual press rams 7*a* which are disposed in the vicinity of the four vertexes and at the center of the rear surface 6*b* of the upper punch 6 which is square in top view. Accordingly, a more uniform pressing force acts on the pressing surface 6*a* of the upper punch 6 which is square in top view. In addition, the lower press ram 5 includes a total of five individual press rams which are disposed in the vicinity of the four vertexes and at the center of the rear surface 4*b* of the lower punch 4 which is square in top view. Accordingly, a more uniform reaction force acts on the pressing surface 4*a* of the lower punch 4 which is square in top view. According to the hot-press device A, even when the dimensions of the pressing surfaces of the pair of punches increase, the uniformity in distribution of the pressing force can be more reliably maintained.

Moreover, the heating furnace 2 in the hot-press device A includes the furnace body 2*a*, the heat insulating container 2*b*, and the heater 2*c* (heating element), and the heat insulating container 2*b* includes the plurality of openings 2*e* through which the individual press rams 7*a* of the upper press ram 7 and the lower press rams 5 (individual press rams) are inserted. Accordingly, for example, compared to a case where no heat insulating material is installed on the upper surface and lower surface of the heat insulating container 2*b* through which the individual press rams 7*a* and the lower press rams 5 (individual press rams) are provided, heat escape from the inside of the heat insulating container 2*b* caused by the individual press rams 7*a* and the lower press rams 5 (individual press rams) can be suppressed to a minimum.

Moreover, the present disclosure is not limited to the above embodiment, and for example, the following modification examples can be considered.

(1) In the above embodiment, the lower punch 4 and the upper punch 6 are square (rectangular) in top view. However, the present disclosure is not limited to this. Various shapes can be considered for shapes of the lower punch and the upper punch, that is, shapes of the pressing surface and the rear surface of the lower punch and the upper punch, according to a shape of the object W to be treated. For example, in a case where pressing surfaces 4*m* and 6*m* and the rear surfaces 4*n* and 6*n* are circular as a lower punch 4A and an upper punch 6A shown in FIG. 3A, the individual press rams are disposed at a center of each of the rear surfaces 4*n* and 6*n* and are disposed at equiangular positions around the center in the vicinity of a peripheral edge of each of the rear surfaces 4*n* and 6*n*.

Figure 3A:
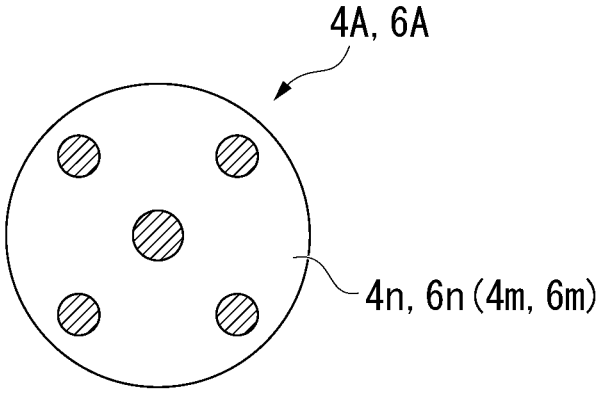
FIG. 3A is a top view showing a disposition example of the individual press rams in the embodiment of the present disclosure.
Figure 3B:
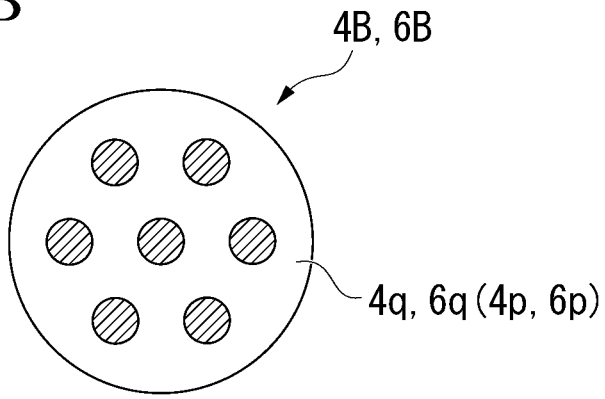
FIG. 3B is a top view showing another disposition example of the individual press rams in the embodiment of the present disclosure.

That is, in an example of FIG. 3A, a total of five individual press rams are disposed at the center of each of the rear surfaces 4*n* and 6*n* and at every 90° around the center in the vicinity of the peripheral edge of each of the rear surfaces 4*n* and 6*n*. Further, in a case where pressing surfaces 4*p* and 6*p* and rear surfaces 4*q* and 6*q* are circular as a lower punch 4B and an upper punch 6B shown in FIG. 3B, a total of seven individual press rams may be disposed at a center of each of the rear surfaces 4*q* and 6*q* and every 60° around the center in the vicinity of a peripheral edge of each of the rear surfaces 4*q* and 6*q*. In addition, an angle division around the center of each of the rear surfaces 4*q* and 6*q* is not limited to 90° or 60°. Moreover, the individual press ram disposed at the center of each of the rear surfaces 4*n* and 6*n* may be omitted as needed. (2) In the above embodiment, the individual press rams 7*a* are disposed in the vicinity of the four vertexes and at the center of the rectangular rear surface 6*b* of the upper punch 6. However, the present disclosure is not limited to this. For example, the individual press rams 7*a* may be disposed only in the vicinity of the four vertexes. In addition, in a case where a shape of the upper punch 6 in top view is polygonal other than rectangular, the individual press rams 7*a* may be disposed only in the vicinity of vertexes of the polygon. In addition, the individual press ram 7*a* may be further disposed at a center of the polygon.

(3) In the above embodiment, the upper press ram 7 includes the plurality of individual press rams 7*a*, the single main press ram 7*b*, and the coupling member 7*c*. However, the present disclosure is not limited to this. For example, the upper press ram 7 may include only the plurality of individual press rams 7*a*.

(4) In the above embodiment, the lower press ram 5 includes five individual press rams. However, the present disclosure is not limited to this. For example, the lower press ram 5 may be constituted by a single cylindrical body having a relatively large diameter. In addition, the lower press ram 5 may have the same configuration as that of the upper press ram 7.

(5) In the above embodiment, the hydraulic cylinder 3 (pressing device) is connected to only the upper press ram 7. However, the present disclosure is not limited to this. The hydraulic cylinder (pressing device) may be connected to any one or both of the lower press ram 5 and the upper press ram 7. That is, the hydraulic cylinder (pressing device) may be connected to the lower press ram 5 instead of the upper press ram 7, or the hydraulic cylinder (pressing device) may be individually connected to each of the lower press ram 5 and the upper press ram 7.

(6) In the above embodiment, the atmospheric pressure in the heating furnace 2 is set to a predetermined vacuum atmosphere by the vacuum pump. However, the present disclosure is not limited to this. For example, heating is performed under normal pressure, and the hydraulic cylinder 3 may be operated to press the object W to be treated in this heated state.

(7) In the above embodiment, the object W to be treated is pressed by the single hydraulic cylinder 3. However, the present disclosure is not limited to this. A plurality of lower pressing units each including the lower press rams 5 and the lower punch 4 may be disposed adjacent to each other, a plurality of upper pressing units each including the hydraulic cylinder 3, the upper press ram 7, and the upper punch 6 may be disposed adjacent to each other, and the object W to be treated may be pressed by the plurality of lower pressing units and the plurality of upper pressing units. In this case, a plurality of objects W to be treated may be accommodated in the heating furnace 2, and the objects W to be treated may be individually pressed by the lower pressing units and the upper pressing units.

(8) In the above embodiment, the diffusion bonding processing and the sintering processing are described as examples of the hot press processing performed by the hot-press device A. However, the present disclosure is not limited to this. The present disclosure can be used for various hot press processing in addition to the diffusion bonding processing and the sintering processing.

(9) In the above embodiment, the support mechanism 1 is provided as a strength member which receives the reaction force of the hydraulic cylinder 3 (pressing device). However, the present disclosure is not limited to this. For example, the reaction force of the hydraulic cylinder 3 (pressing device) may be received by the heating furnace 2 by providing sufficient strength to the heating furnace 2. In the case, the extensible portion 8 may be omitted.

According to the present disclosure, even when dimension of a pressing surface of a punch increase, uniformity in distribution of a pressing force can be maintained.

What is claimed is:

1. A hot-press device comprising:

a heating furnace;

an extensible portion which is extensible;

a pair of punches which includes an upper punch and a lower punch provided in the heating furnace and vertically facing each other;

a lower press ram which is connected to a lower surface of the lower punch;

an upper press ram which is connected to an upper surface of the upper punch; and a pressing device which is connected to any one or both of the lower press ram and the upper press ram and presses the pair of punches such that the pair of punches are close to each other, wherein the lower press ram and the upper press ram or the lower press ram or the upper press ram includes a plurality of individual press rams which are disposed at intervals, each of the plurality of individual press rams having one end coupled to the pair of punches, wherein the upper press ram comprises:

a single main press ram which is provided on a side of the pressing device; and a coupling member which couples the plurality of individual press rams and the main press ram to each other, and wherein the extensible portion surrounds the main press ram and a lower end of the extensible portion is connected to an upper end of the heating furnace and an upper end of the extensible portion is fixed.

2. The hot-press device according to claim 1, wherein each of the upper punch and the lower punch includes a pressing surface which abuts an object to be treated and a rear surface opposite to the pressing surface, the object to be treated being disposed between the upper punch and the lower punch, the pressing surface and the rear surface being rectangular, and wherein the plurality of individual press rams are disposed at a center of the rear surface and locations closer to four vertexes of the rear surface than middle portions between the four vertexes and the center.

3. The hot-press device according to claim 1, wherein each of the upper punch and the lower punch includes a pressing surface which abuts an object to be treated and a rear surface opposite to the pressing surface, the object to be treated being disposed between the upper punch and the lower punch, the pressing surface and the rear surface being circular, and wherein the plurality of individual press rams are disposed at a center of the rear surface and at a plurality of equiangular positions around the center at locations closer to a peripheral edge of the rear surface than middle portions between the center and the peripheral edge of the rear surface.

4. The hot-press device according to claim 1, wherein the heating furnace includes:

a furnace body;

a heat insulating container which is provided in the furnace body and accommodates the pair of punches; and a heating element which is provided around the pair of punches in the heat insulating container, wherein the heat insulating container includes a plurality of openings through which the plurality of individual press rams are inserted.

* * * * *